US005535908A

United States Patent [19]

Sheu

[11] Patent Number: 5,535,908

[45] Date of Patent: Jul. 16, 1996

[54] RECEPTACLE COMBINATION FOR MILK POWDER

[76] Inventor: Miin-Tsang Sheu, No. 156 Cheng Kung Road, Chang Hua City, Taiwan

[21] Appl. No.: 338,748

[22] Filed: Nov. 4, 1994

[51] Int. Cl.[6] ..... B65D 21/036

[52] U.S. Cl. ..... 220/4.27; 206/509; 220/4.26; 222/143

[58] Field of Search ..... 222/141, 143; 206/501, 509; 220/4.26, 4.27, 23.6, 23.83, 23.86

[56] References Cited

U.S. PATENT DOCUMENTS

| | | | |
|---|---|---|---|
| 647,925 | 4/1900 | Kirby | 220/4.27 |
| 2,645,375 | 7/1953 | Topfer | 220/4.27 |
| 3,067,896 | 12/1962 | Berg et al. | 220/4.27 |
| 3,281,006 | 10/1966 | Tohchung Wei | 222/143 |
| 3,972,450 | 8/1976 | Walters | 222/143 |
| 4,513,865 | 4/1985 | Melzi et al. | 206/509 |

FOREIGN PATENT DOCUMENTS

| | | | |
|---|---|---|---|
| 907953 | 3/1946 | France | 220/4.27 |

*Primary Examiner*—Stephen J. Castellano
*Attorney, Agent, or Firm*—Beveridge, DeGrandi, Weilacher & Young

[57] ABSTRACT

A receptacle device includes two or more containers for accommodating milk powder separately. The containers each includes an open upper end having an outer thread formed in the outer peripheral portion. An annular flange extends downward from the bottom plate and has an inner thread for engaging with the outer thread. A cover may engage with the open upper end for enclosing the container. A mouth is formed in each of the containers for pouring the milk powder. Two or more caps may engage with and may enclose the mouth.

2 Claims, 5 Drawing Sheets

RECEPTACLE COMBINATION FOR MILK POWDER

BACKGROUND OF THE INVENTION

1. Field of the Invention

The present invention relates to a receptacle, and more particularly to a receptacle combination for milk powder.

2. Description of the Prior Art

Typically, milk powder is received in a large container and is scooped to a bottle for making milk for babies. However, the milk powder may not be precisely disposed into the bottle with scoop or spoon.

The present invention has arisen to mitigate and/or obviate the afore-described disadvantages of the conventional containers for milk powder.

SUMMARY OF THE INVENTION

The primary objective of the present invention is to provide a receptacle combination for accommodating milk powder and for pouring milk powder into bottle.

In accordance with one aspect of the invention, there is provided a receptacle combination comprising at least two container bodies for accommodating milk powder, the container bodies each including an open upper end having an outer peripheral portion, an outer thread formed in the outer peripheral portion of the open upper end, a bottom plate, an annular flange extended downward from the bottom plate and having a first inner thread formed therein for engaging with the outer thread, and a mouth for pouring the milk powder, a cover including a second inner thread for engaging with the outer thread, and at least two cap means for engaging with and for enclosing the mouth. The mouth includes a bottom portion flush with the bottom plate for easily pouring milk powder.

Further objectives and-advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
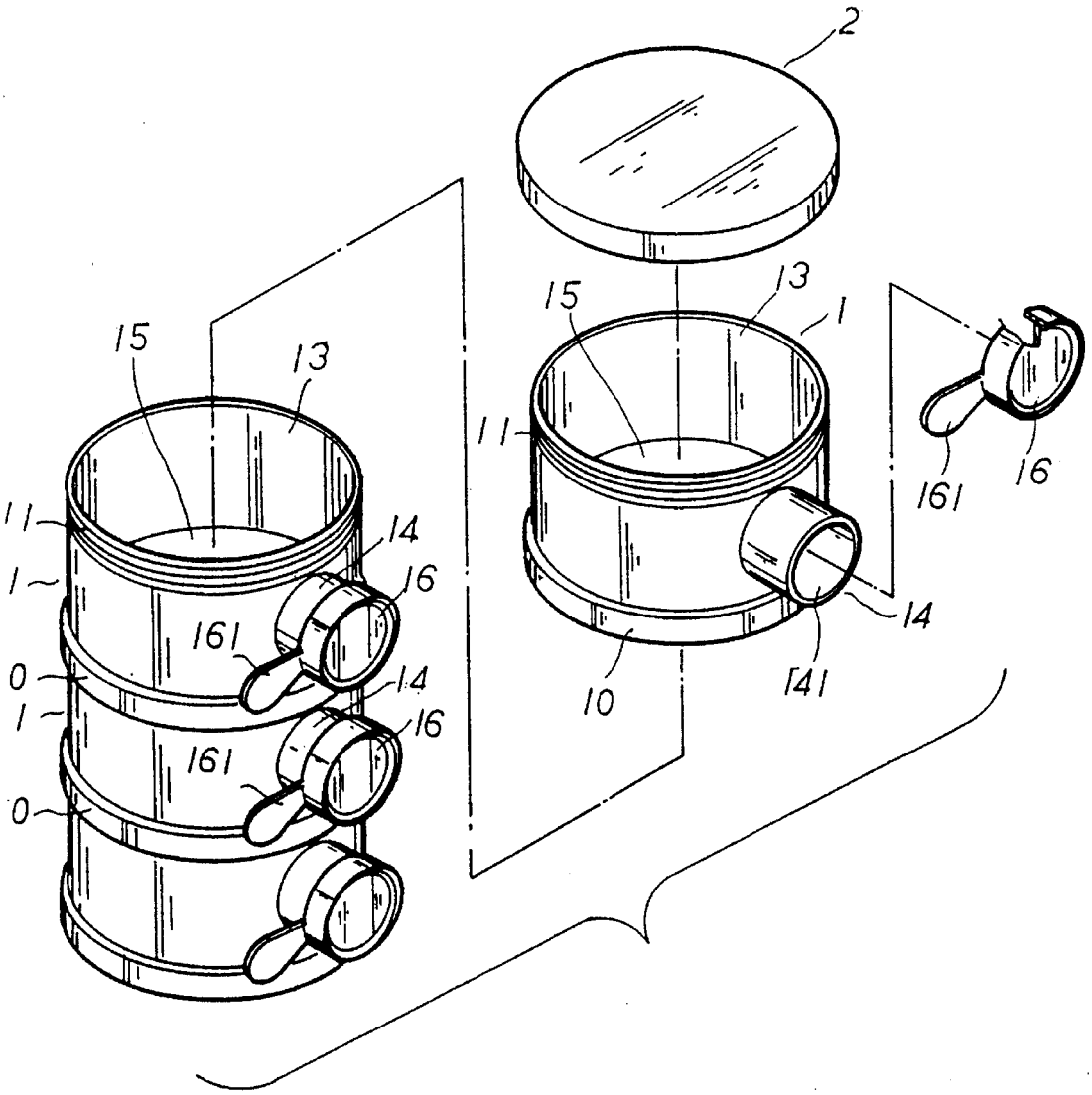
FIG. 1 is an exploded view of a receptacle combination in accordance with the present invention.
Figure 2:
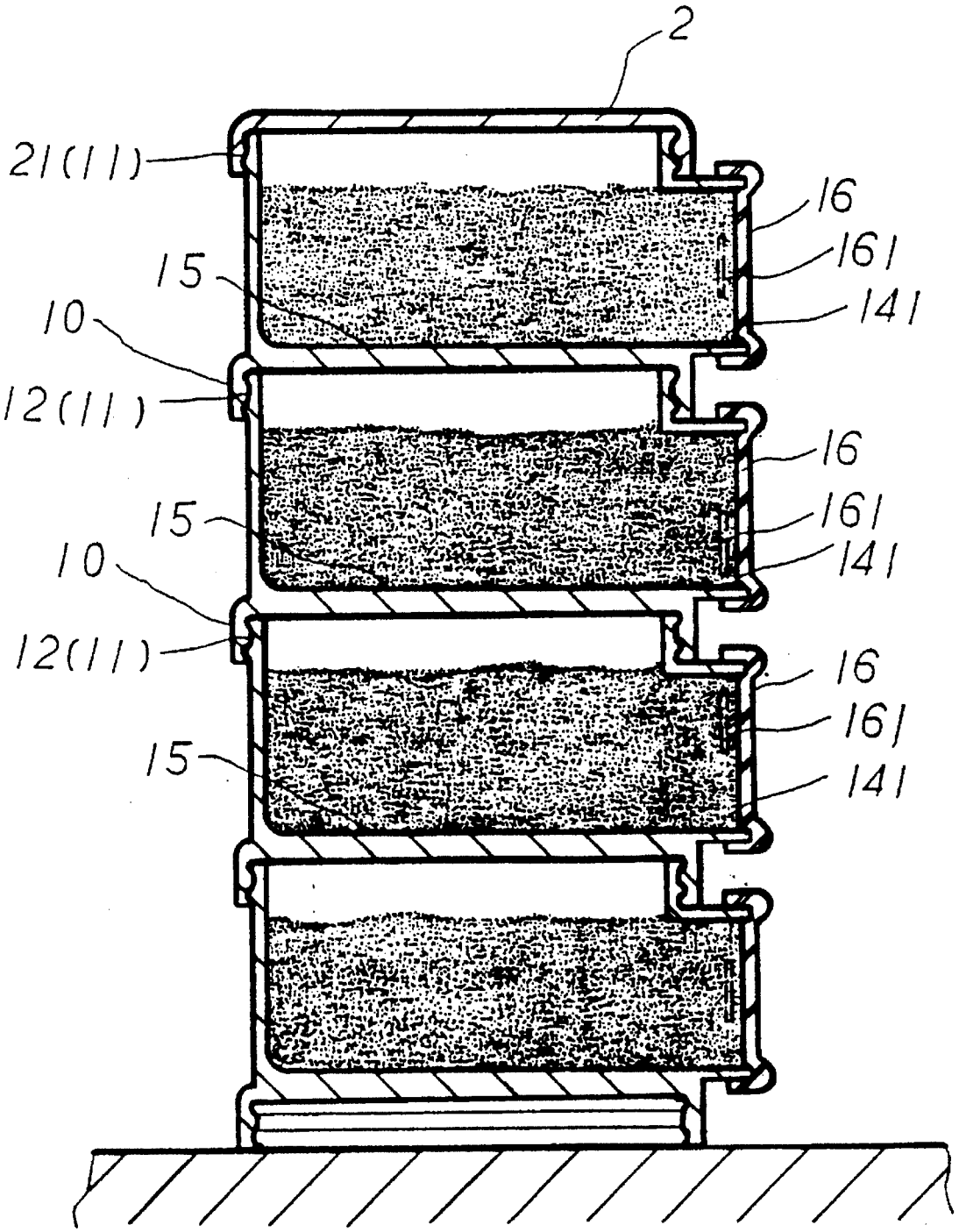
FIG. 2 is a cross sectional view of the receptacle combination.
Figure 3:
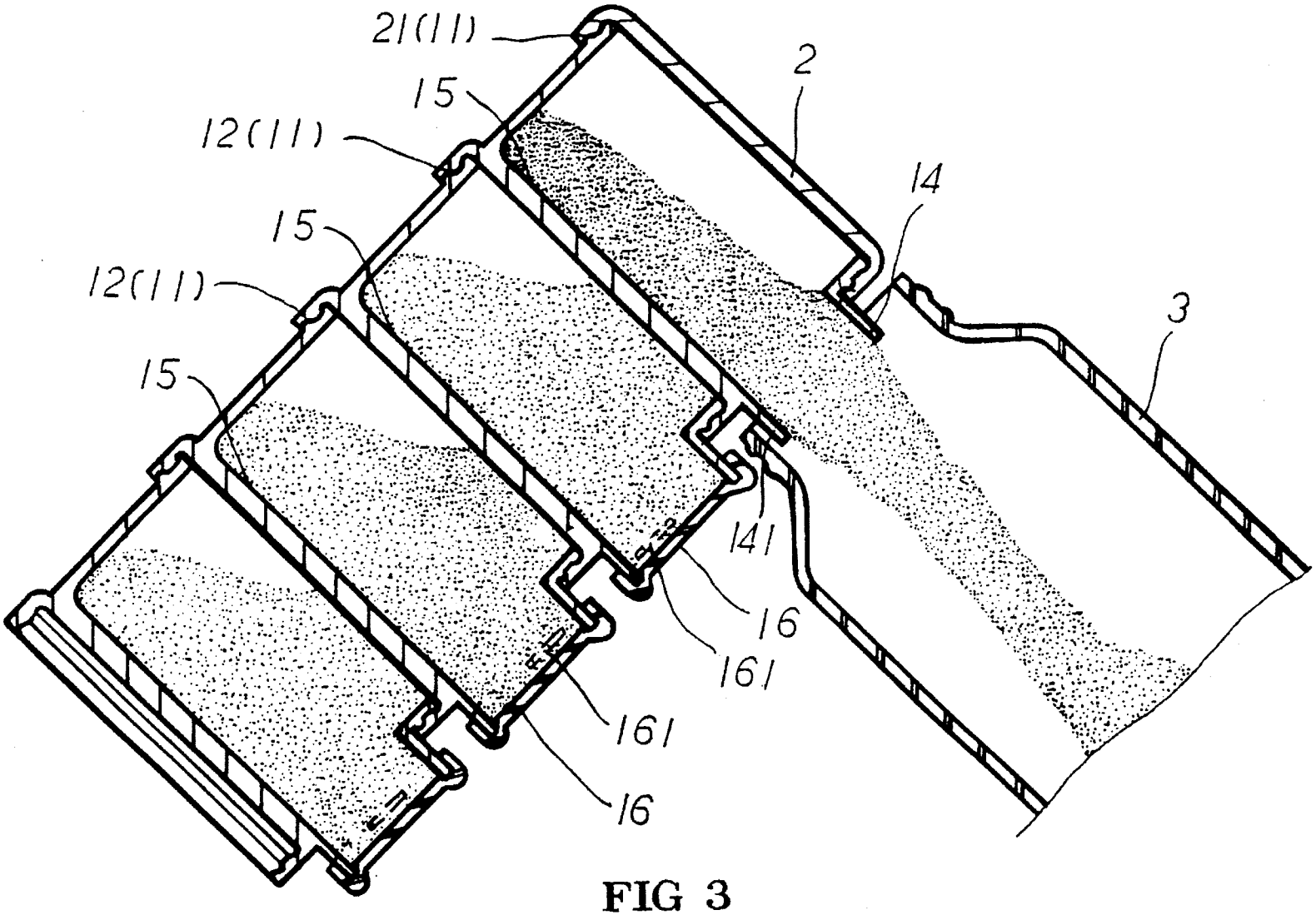
FIGS. 3, 4 and 5 are cross sectional views illustrating the application of the receptacle combination.

Referring to the drawings, and initially to FIGS. 1 and 2, a receptacle combination in accordance with the present invention comprises a number of container bodies 1 for accommodating milk powder. The bodies 1 each includes an open top 13 having an outer thread 11 formed on the outer peripheral portion and including a bottom plate 15. The bodies 1 each includes an annular flange 10 extended downward from the bottom plate 15 and having an inner thread 12 formed therein for engaging with the outer thread 11 of the other bodies so as to couple the bodies 1 together. The bodies 1 each further includes a mouth 14 having a bottom portion 141 flush with the bottom plate 15, best shown in FIGS. 2 and 3, such that the milk powder can be easily removed or poured out from the bodies, best shown in FIG. 3. A number of caps 16 are engaged with the mouths 14 for temporarily closing the container bodies 1. The caps 16 each includes an ear 161 for opening the caps 16. A cover 2 is provided for covering the uppermost container body and includes an inner thread 21 for engaging with the outer thread 11 of the container bodies 1.

Figure 4:
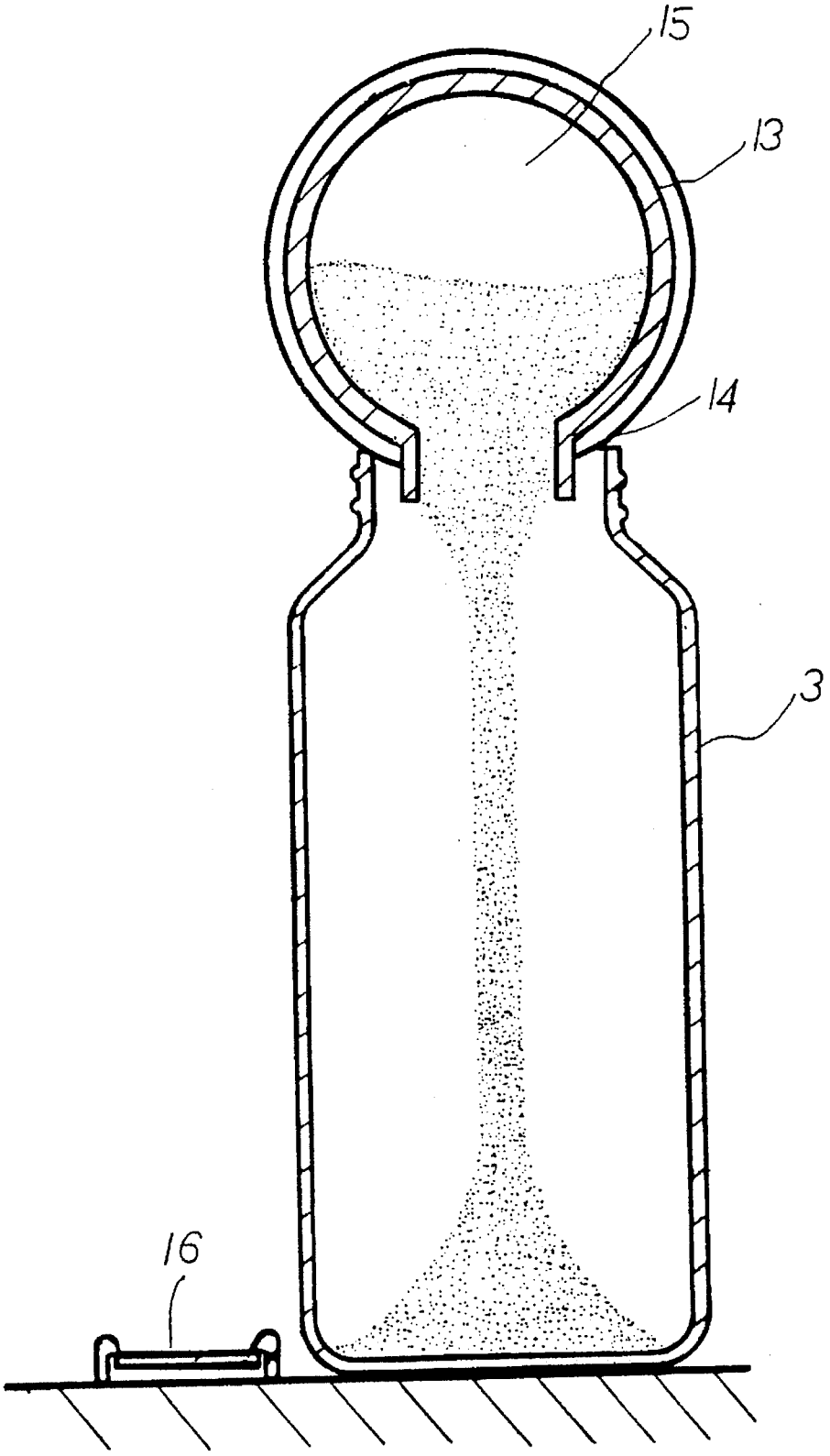

Referring next to FIG. 4, it is preferable that the size of the mouths 14 is smaller than the open mouth of the bottles 3 such that the mouths 14 may be engaged in the open mouth of the bottles 3 and such that the milk powder may be easily poured into the bottle 3. After use, the empty container body 1 is preferably engaged to the bottom portion of the other bodies.

Figure 5:
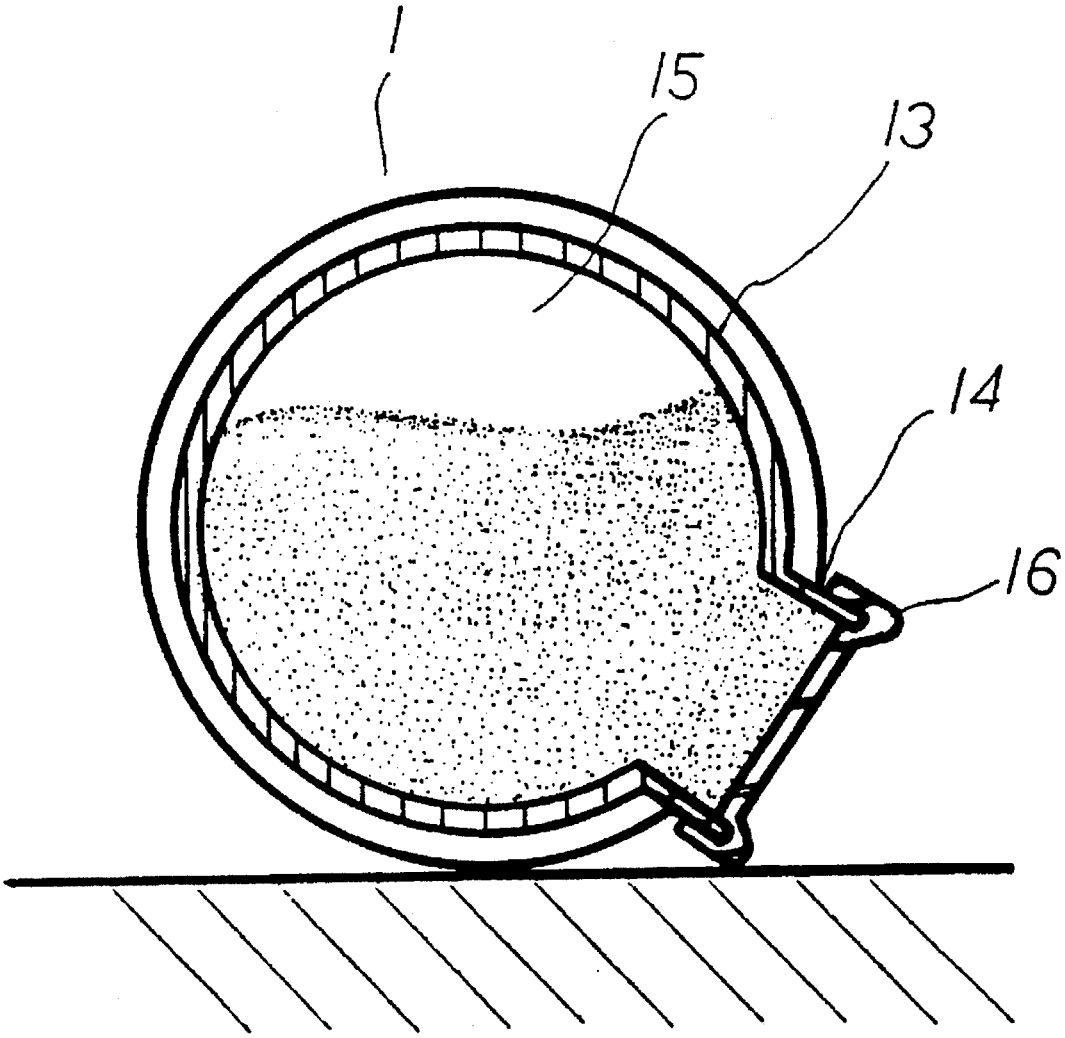

Referring next to FIG. 5, the mouth 14 and the cap 16 may retain the receptacle bodies 1 in a stable position.

Accordingly, the receptacle combination in accordance with the present invention may accommodate milk powder separately in a number of container bodies and the milk powder can be easily poured into bottles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stacked receptacle combination comprising:

at least two container bodies for accommodating milk powder, each of said container bodies having an open upper end and a closed bottom end, an outer thread formed about the outer peripheral portion of said upper end, an annular flange extending downward from said bottom end and having an inner thread formed therein for engaging with the outer thread of another of said container bodies to form a stack of said container bodies, each of said container bodies having a mouth portion extending from a side wall of said container bodies for pouring milk powder accommodated within said bodies, a cover having an annular flange depending from its peripheral edge and provided with an inner thread for engaging with said outer thread of the container body at the upper end of the stack of containers, and a cap for removably engaging with and closing said mouth on each of said container bodies, wherein each of said caps has an ear portion extending outwardly therefrom to facilitate removal of said cap from said mouth portion.

2. The stacked receptacle combination as defined in claim 1 wherein each of said mouth portions has its bottom portion flush with the bottom of said container body.

* * * * *